United States Patent [19]

Robbins

[11] Patent Number: 4,894,961

[45] Date of Patent: Jan. 23, 1990

[54] LAWN MOWER SHELTER

[76] Inventor: Robert D. Robbins, 4827 Parkside, Memphis, Tenn. 38117

[21] Appl. No.: 222,175

[22] Filed: Jul. 21, 1988

[51] Int. Cl.[4] ..... E04B 1/344; E04H 6/02

[52] U.S. Cl. ..... 52/69; 52/79.4; 52/DIG. 14

[58] Field of Search ..... 52/68, 69, 79.4, DIG. 14; 150/52 K

[56] References Cited

U.S. PATENT DOCUMENTS

| | | | |
|---|---|---|---|
| 3,172,392 | 3/1965 | Schultz | 52/80 |
| 3,949,528 | 4/1976 | Hartger et al. | 52/66 |
| 4,306,390 | 12/1981 | Brown | 52/DIG. 14 |
| 4,673,227 | 6/1987 | Anderson | 312/100 |

FOREIGN PATENT DOCUMENTS

| | | | |
|---|---|---|---|
| 742399 | 9/1966 | Canada | 52/69 |
| 814659 | 9/1951 | Fed. Rep. of Germany | 52/69 |
| 815100 | 9/1951 | Fed. Rep. of Germany | 52/DIG. 14 |
| 2424389 | 12/1979 | France | 52/66 |
| 2453245 | 12/1980 | France | 52/DIG. 14 |
| 109677 | 8/1966 | Norway | 52/69 |
| 496476 | 11/1938 | United Kingdom | 52/169 |

OTHER PUBLICATIONS

Popular Science; Feb. 1958 (p. 18).

*Primary Examiner*—Michael Safavi

*Attorney, Agent, or Firm*—Walker & McKenzie

[57] ABSTRACT

A shelter for enclosing a walk-behind type lawn mower. The shelter includes a housing having a hollow interior for receiving the lawn mower and having an opening for allowing the lawn mower to be pushed into and pulled from the interior and includes a door for selectively closing the opening. The interior of the housing has a width slightly wider than the width of the lawn mower, has a length slightly longer than the length of the lawn mower, and has a height slightly higher than the height of the lawn mower.

1 Claim, 1 Drawing Sheet

LAWN MOWER SHELTER

BACKGROUND OF THE INVENTION

1. Field of the Invention

The present invention relates, in general, to a shelter for walk-behind type lawn mowers and the like.

2. Description of the Related Art

Walk-behind lawn mowers and the like are typically sheltered in garages, carports, storage buildings and the like where available. However, because of lack of availability or space in such structures, many walk-behind lawnmowers are left out in the open merely covered with a tarpaulin or the like, or left uncovered and completely exposed to the elements, resulting in likely damage and early deterioration of the lawn mower.

SUMMARY OF THE INVENTION

The present invention is directed toward providing an improved shelter for walk-behind type lawn mowers. The concept of the present invention is to provide an attractive, low-cost, low maintenance shelter for walk-behind type lawn mowers.

A shelter of the present invention includes a housing having a hollow interior for receiving the lawn mower and having an opening for allowing the lawn mower to be pushed into and pulled from the interior and includes a door for selectively closing the opening. The interior of the housing has a width slightly wider than the width of the lawn mower, has a length slightly longer than the length of the lawn mower, and has a height slightly higher than the height of the lawn mower.

DESCRIPTION OF THE PREFERRED EMBODIMENT

Figure 1:
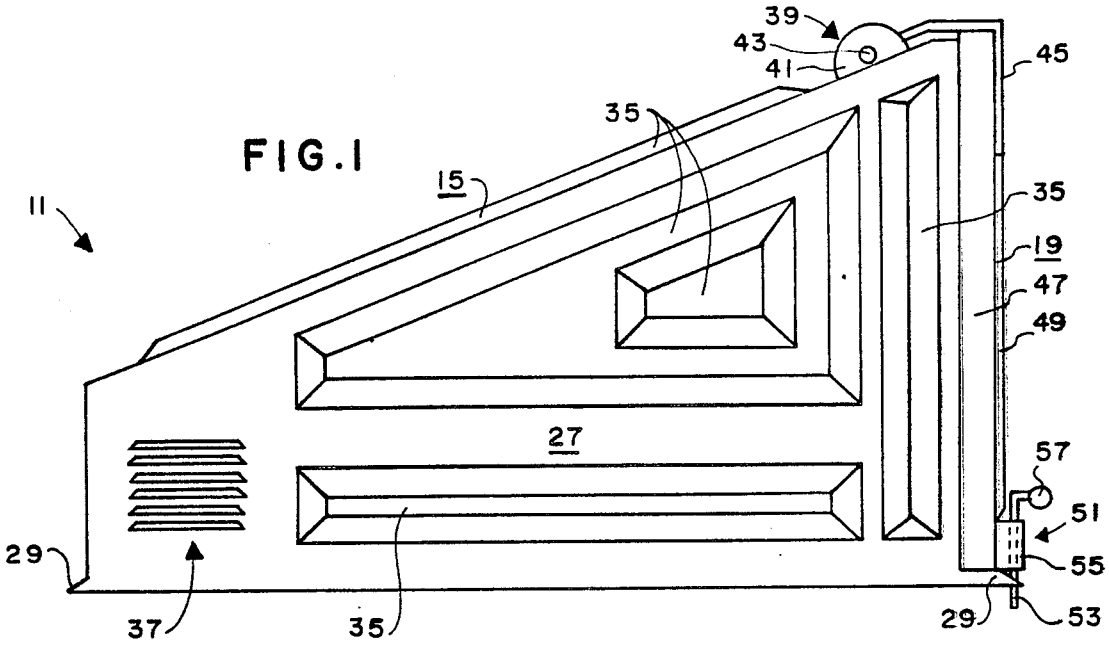
FIG. 1 is a side elevation view of the shelter of the present invention.
Figure 2:
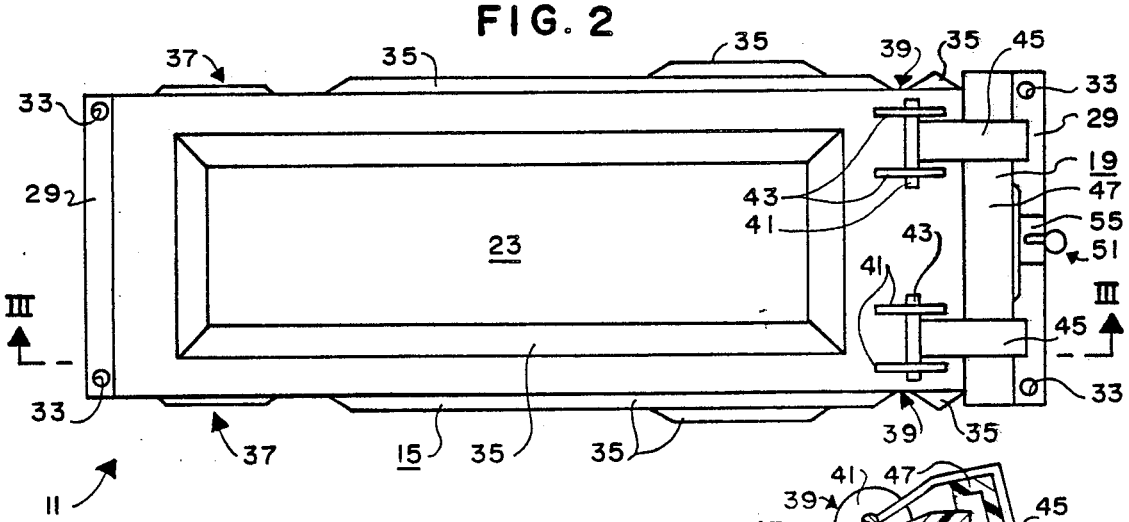
FIG. 2 is a top plan view thereof.
Figure 3:
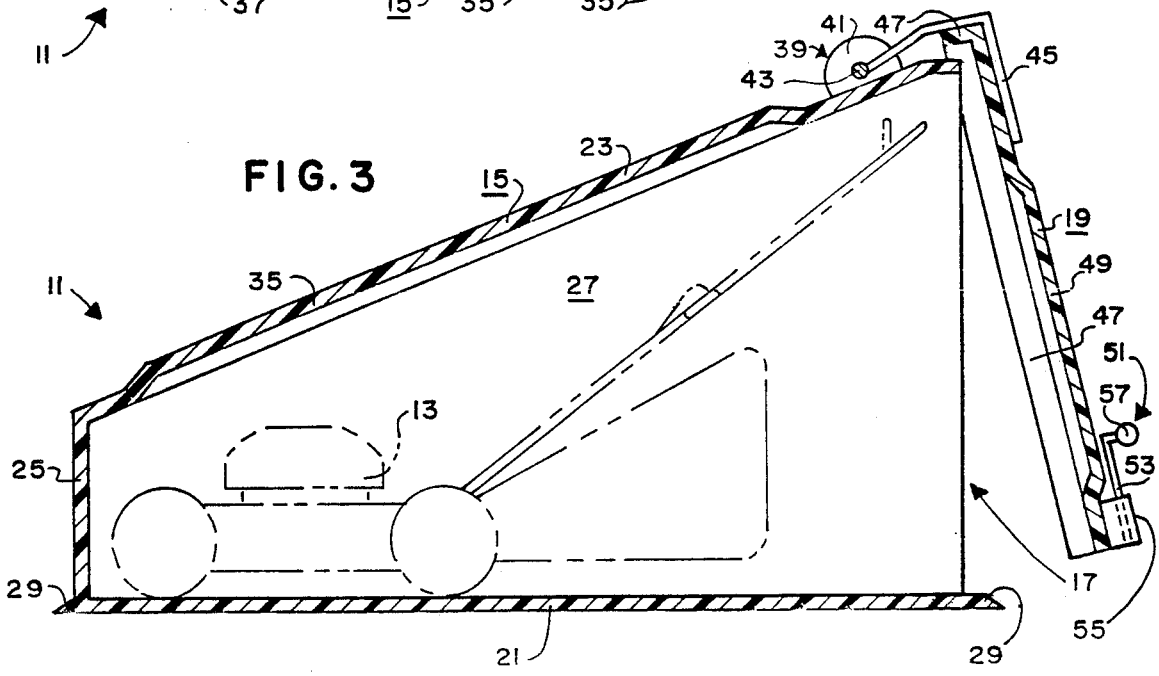
FIG. 3 is a somewhat diagrammatic sectional view substantially as taken on line III—III of FIG. 2 showing the door thereof partly open and showing a walk-behind type lawn mower in broken lines.

The preferred embodiment of the shelter 11 of the present invention is shown in FIGS. 1–3 and is used to enclose a walk-behind type lawn mower 13. The shelter 11 includes, in general, a hollow housing 15 having an opening 17 (see FIG. 3) and a door 19 for selectively closing the opening 17.

The housing 15 preferably includes a bottom member 21, a top member 23, a rear wall member 25, and a pair of side wall members 27 joined to one another as clearly shown in the drawings to form a hollow box-like structure having a substantially open front to allow the lawn mower 13 to be pushed into and pulled from the interior of the housing 15, etc., as will now be apparent to those skilled in the art. Flanges 29 are preferably provided on the bottom member 21 for allowing pegs or the like (not shown) to extend through apertures 33 therein to secure the housing 15 to the ground or the like. A flange 29 preferably extends outward of each end of the bottom member 21 as clearly shown in the drawings. Ridges 35 are preferably formed in the top member 23 and side wall members 27 of the housing 15 to strengthen the members 23, 27 and to provide an ornamental design thereon. The housing 15 preferably has vent apertures 37 therein for allowing a transfer of air between the interior and exterior of the housing 15 even when the door 19 is shut to close the opening 17. The vent apertures 37 may consist of a number of louvers in the side wall members 27 arranged so as to allow air to be transferred therethrough while preventing the passage of rain and the like as will now be apparent to those skilled in the art. The specific shape and size of the housing 15 may vary as will now be apparent to those skilled in the art. The housing 15 is preferably sized so as to allow the lawn mower 13 to be easily pushed into. The housing 15 is preferably shaped with the top member 23 angled downward toward the rear wall member 25 to provide clearance for the handle of the lawn mower 13 as shown in FIG. 3, etc. The housing 15 may be manufactured in a number of manners and of a number of materials as will now be apparent to those skilled in the art. The housing 15 is preferably constructed as an integral, one-piece unit out of a substantially rigid plastic or the like by being molded, etc., as will now be apparent to those skilled in the art.

The shelter 11 preferably includes hinge means 39 or the like for pivotally attaching the door 19 to the housing 15 to allow the door 19 to be moved between a closed position as shown in FIGS. 1 and 2 and a fully open position (not shown) to allow the lawn mower 13 to be easily pushed into and pulled from the interior of the housing 15 as will now be apparent to those skilled in the art. Each hinge means 39 preferably includes a pair of spaced ears 41 attached to the top member 23 adjacent the opening 17, a pivot rod 43 extending through the ears 41, and a hinge plate 45 having one end attached to the pivot rod 43 and having another end attached to the door 19. The ears 41 are preferably constructed as an integral, one-piece unit with the housing 15 in any manner now apparent to those skilled in the art.

The door 19 preferably has flanges 47 at the top and sides thereof for forming a substantially fluid-tight seal with the housing 15 adjacent the opening 17 when the door 19 is closed as will now be apparent to those skilled in the art. One or more ridges 49 are preferably formed in the door 19 to strengthen the door 19 and to provide an ornamental design thereon. The door 19 is sized and shaped so as to conform with the size and shape of the opening 17 in the housing and may be manufactured in a number of manners and of a number of materials as will now be apparent to those skilled in the art. The door 19 is preferably constructed as an integral, one-piece unit out of a substantially rigid plastic or the like by being molded, etc., as will now be apparent to those skilled in the art.

The shelter 11 preferably includes latch means 51 for holding the door 19 in the closed position. The latch means 51 may consist of a rod member 53 movably mounted within a guide member 55 attached to the door 19. The rod member 53 is preferably slidably mounted within the guide member 55 and preferably has a handle portion 57 for allowing it to be easily moved between a locked position with the distal end thereof extending through an aperture or slot in a flange 29 of the housing 15 into the ground or the like to lock the door 19 in the closed position (see FIGS. 1 and 2) and an open position in which the distal end thereof is above the flange 29 (see FIG. 3) to allow the door 19 to be easily pivoted to a fully open position, etc., as will now be apparent to those skilled in the art. The handle portion 57 may additionally provide a 'handle' to allow the door 19 to be moved between the open and closed positions. The guide member 55 is preferably constructed as an integral, one-piece unit with the door 19 in any manner now apparent to those skilled in the art.

The use and operation of the shelter 11 is quite simple. The shelter 11 is preferably anchored to the ground or the like at the desired location by driving pegs or the like (not shown) through the apertures 33 in the flanges 29 and into the ground, etc., as will now be apparent to those skilled in the art. The door 19 can then be opened by sliding the rod member 53 of the latch means 51 to the open position and merely pivoting the door 19 about the hinge means 39. With the door 19 in the open position, the lawn mower 13 can easily be pushed into the interior of the housing 15 for storage, etc. The door 19 can then be pivoted to the closed position and the rod member 53 of the latch means 51 slid to the locked position to prevent inadvertent opening of the door 19. To remove the lawn mower 13 from the shelter 11, the rod member 53 is slid to the open position and the door 19 pivoted to the open position; the lawn mower 13 can then be pulled from the interior of the housing 15.

Although the present invention has been described and illustrated with respect to a preferred embodiment and a preferred use therefor, it is not to be so limited since modifications and changes can be made therein which are within the full intended scope of the invention.

I claim:

1. The combination of a walk-behind type lawn mower, and an improved shelter for enclosing said walk-behind type lawn mower, said lawn mower having a width, a length and a height, wherein said improved shelter comprises:

(a) a housing having a hollow interior for receiving said lawn mower, said interior having a width slightly wider than said width of said lawn mower, having a length slightly longer than said length of said lawn mower, and having a height slightly higher than said height of said lawn mower; said housing having an opening for allowing said lawn mower to be pushed into and pulled from said interior; said housing including a bottom member, a top member, a rear wall member, and a pair of side wall members joined to one another to form a hollow box-like structure having a substantially open front to allow said lawn mower to be pushed into and pulled from the interior of said housing; said bottom member having first and second ends, said housing including a flange extending outward of each of said first and second ends of said bottom member and having ridges formed in said top member and said side wall members thereof to strengthen said top member and said side wall members; said housing having vent apertures therein for allowing a transfer of air between the interior and exterior of said housing, said vent apertures including a number of louvers in said side wall members arranged so as to allow air to be transferred therethrough while preventing the passage of rain; said housing being shaped with said top member angled downward toward said rear wall member to provide clearance for the handle of said lawn mower;

(b) a door for selectively closing said opening; and (c) hinge means for pivotally attaching said door to said housing to allow said door to be moved between a closed position and a fully open position to allow said lawn mower to be easily pushed into and pulled from the interior of said housing; each hinge means including a pair of spaced ears attached to said top member adjacent said opening, a pivot rod extending through said ears, and a hinge plate having one end attached to said pivot rod and having another end attached to said door; said ears of said hinge means being molded as an integral, one-piece unit with said housing.

* * * * *